United States Patent [19]

Ott et al.

[11] 4,433,491

[45] Feb. 28, 1984

[54] AZIMUTH DETERMINATION FOR VECTOR SENSOR TOOLS

[75] Inventors: Paul W. Ott, Pasadena; Harold J. Engebretson, Yorba Linda; Philip M. LaHue, West Lake Village; Brett H. Van Steenwyk, San Marino, all of Calif.

[73] Assignee: Applied Technologies Associates, San Marino, Calif.

[21] Appl. No.: 351,744

[22] Filed: Feb. 24, 1982

[51] Int. Cl.[3] ..... G01C 19/38

[52] U.S. Cl. ..... 33/302; 33/304

[58] Field of Search ..... 33/302, 304, 312, 313, 33/324

[56] References Cited

U.S. PATENT DOCUMENTS

| | | | |
|---|---|---|---|
| 2,309,905 | 2/1943 | Irwin et al. | 33/302 |
| 2,635,349 | 4/1953 | Green | 33/302 |
| 2,674,049 | 4/1954 | James, Jr. | 33/302 |
| 2,681,657 | 6/1954 | Widess | 33/302 |
| 2,806,295 | 9/1957 | Ball | 33/302 |
| 3,037,295 | 6/1962 | Roberson | 33/302 |
| 3,137,077 | 6/1964 | Rosenthal | 33/302 |
| 3,241,363 | 3/1966 | Alderson et al. | 73/178 |
| 3,308,670 | 3/1967 | Granqvist | 74/5.34 |
| 3,561,129 | 2/1971 | Johnston | 33/302 |
| 3,753,296 | 8/1973 | Van Steenwyk | 33/304 |
| 3,894,341 | 7/1975 | Kapeller | 33/324 |
| 3,896,412 | 7/1975 | Rohr | 33/304 |
| 4,021,774 | 5/1977 | Asmundsson et al. | 33/313 |
| 4,199,869 | 4/1980 | Van Steenwyk | 33/302 |
| 4,238,889 | 12/1980 | Barriac | 33/304 |
| 4,244,116 | 1/1981 | Barriac | 33/304 |
| 4,293,046 | 10/1981 | Van Steenwyk | 33/304 |

FOREIGN PATENT DOCUMENTS

| | | | |
|---|---|---|---|
| 2080972 | 2/1982 | United Kingdom | 33/302 |

*Primary Examiner*—Willis Little

*Attorney, Agent, or Firm*—William W. Haefliger

[57] ABSTRACT

This invention relates to mapping or survey apparatus and methods, and more particularly concerns derivation of the azimuth output indications for such apparatus in a borehole from the outputs or output indications of either an inertial angular rate vector sensor (or sensors) and an acceleration vector sensor (or sensors), or a magnetic field vector sensor (or sensors), and from the outputs of an acceleration vector sensor (or sensors). Borehole tilt is also derived.

32 Claims, 12 Drawing Figures

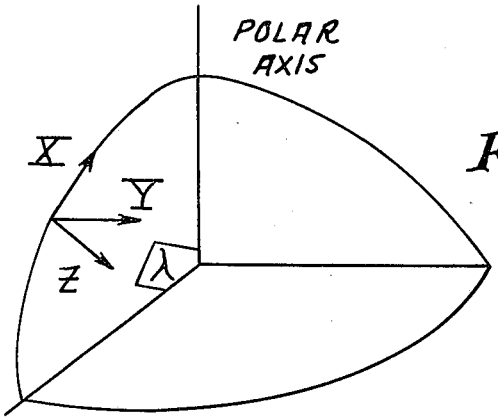
FIG. 1.
FIG. 1a.
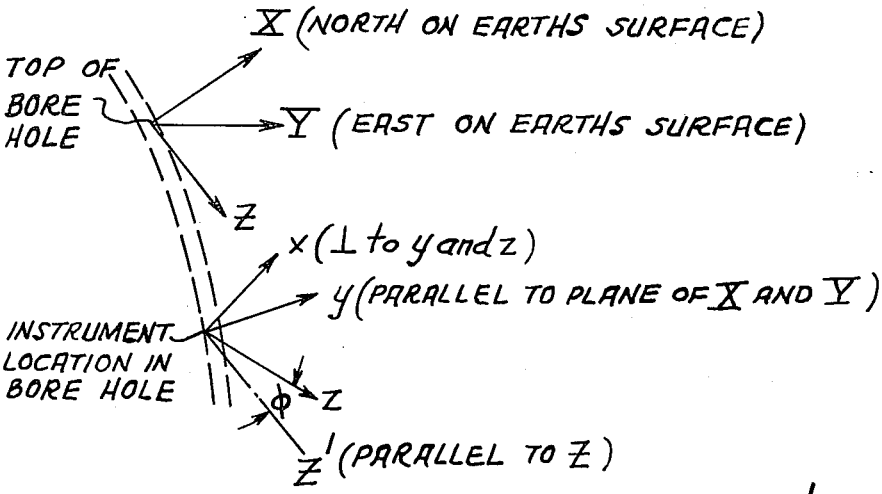
FIG. 2.
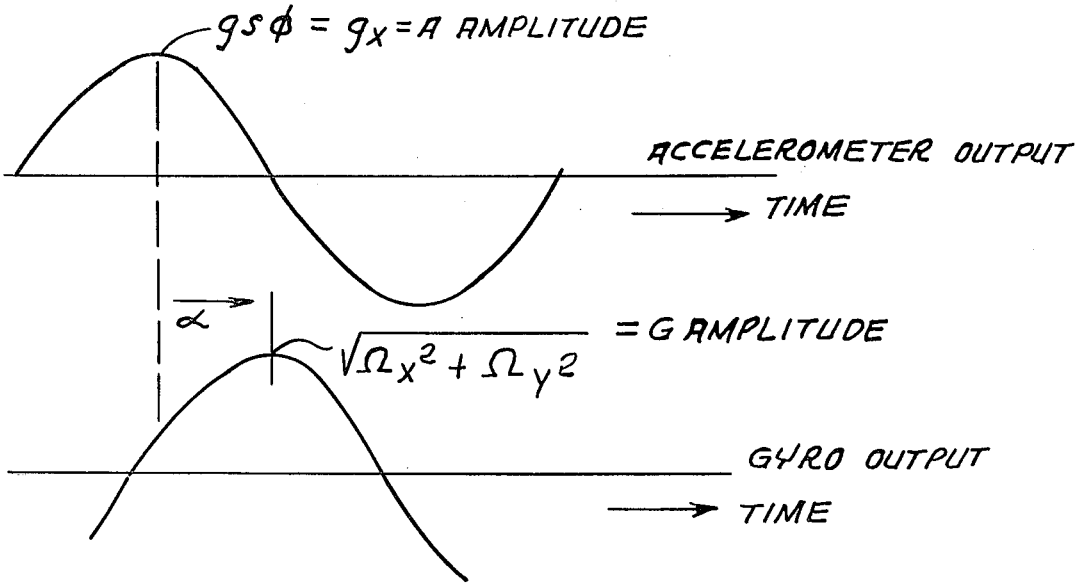

$\phi$ = INCLINATION ANGLE $\Omega_B$ = EARTH RATE COMPONENT IN HORIZONTAL PLANE & BOREHOLE/GRAVITY VECTOR PLANE $$A\ AMPLITUDE = \left(G_1^2 + G_2^2\right)^{\frac{1}{2}}$$

$$A\ PHASE = \beta = ARCTAN\left(\frac{-g_2}{g_1}\right)$$

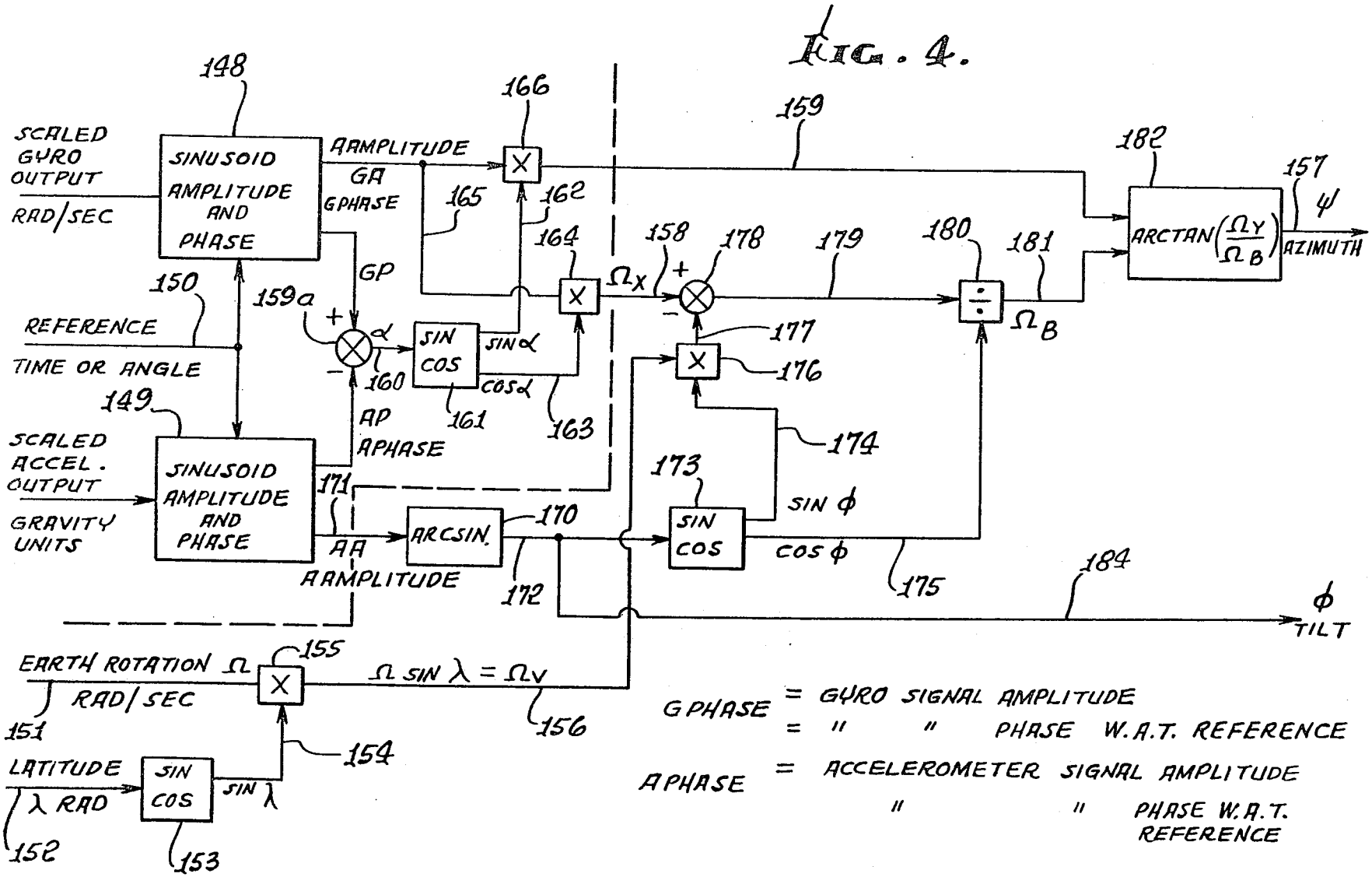
FIG. 4.
SCALED GYRO OUTPUT
RAD/SEC
SINUSOID AMPLITUDE AND PHASE
148
150
REFERENCE
TIME OR ANGLE
149
SCALED ACCEL. OUTPUT
GRAVITY UNITS
SINUSOID AMPLITUDE AND PHASE
AMPLITUDE
GA
GPHASE
GP
159a
AP
APHASE
AA
AAMPLITUDE
EARTH ROTATION Ω
RAD/SEC
151
LATITUDE
λ RAD
152
SIN λ
SIN COS
153
154
155
Ω SIN λ = Ωv
156
166
162
164
165
Ωx
158
178
177
176
174
SIN α
COS α
SIN COS
161
160
163
170
171
172
ARCSIN
173
SIN COS
SIN φ
COS φ
175
179
180
181
Ωβ
182
ARCTAN(Ωy/Ωβ)
157
ψ
AZIMUTH
184
φ
TILT
GPHASE = GYRO SIGNAL AMPLITUDE
" " PHASE W.A.T. REFERENCE
APHASE = ACCELEROMETER SIGNAL AMPLITUDE
" " PHASE W.A.T. REFERENCE FIG. 9.
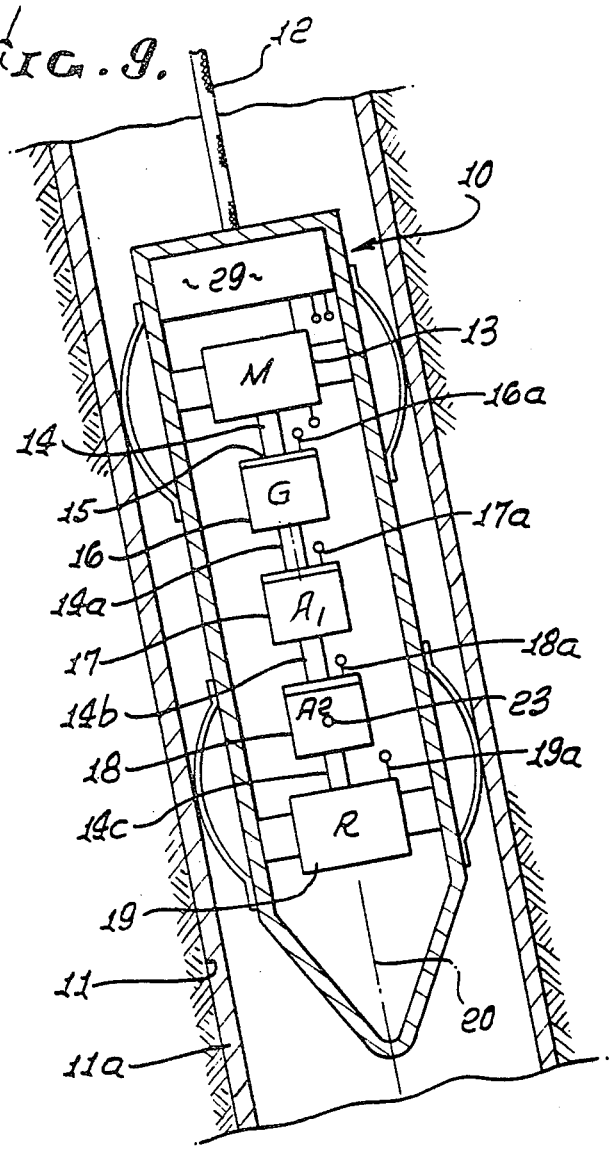
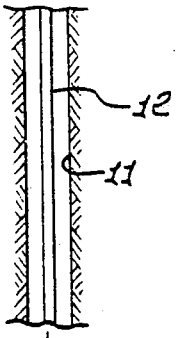
FIG. 10.
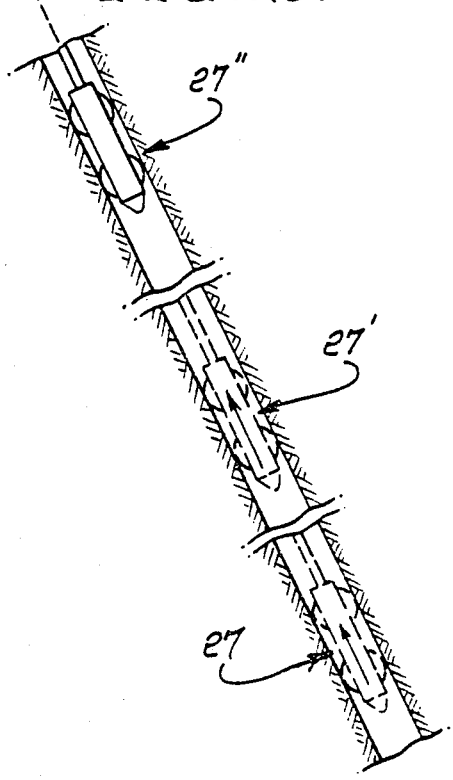

150
131
132a
133a
131a
132
115
117
216
116
113
134a
134
135
133
110
181
124
111
113
110
114
170
170
120
180
M
122
123
127
124
125a
125
G1
123a
127a
125a
G2
118
112
225
128
123b
170
126a
A1
126
120
128
123c
A2
226
226a
211
121
123d
210
214
221
212
220
119

AZIMUTH DETERMINATION FOR VECTOR SENSOR TOOLS

BACKGROUND OF THE INVENTION

This invention relates generally to mapping or survey apparatus and methods, and more particularly concerns derivation of the azimuth output indications for such apparatus from the outputs or output indications of either an inertial angular rate vector sensor (or sensors) and an acceleration vector sensor (or sensors), or a magnetic field vector sensor (or sensors), and from the outputs of an acceleration vector sensor (or sensors).

U.S. Pat. No. 3,753,296 describes the use of a single inertial angular rate sensor, or "rate-of-turn-gyroscope", and a single acceleration sensor, both having their input axes of sensitivity nominally normal to the direction of travel in a borehole and parallel to each other for survey in a well or bore-hole. In this case, both sensors are rotated about an axis parallel to the borehole by either the carrying structure and container or by a rotatable frame internal to the survey tool. U.S. Pat. No. 4,199,869 describes the use of one or two dual axis inertial angular rate sensors in combination with a dual axis acceleration sensor for survey in a well or borehole. Again in this case, the sensors are rotated about an axis parallel to the borehole by either the carrying structure or by a rotatable frame internal to the survey tool. U.S. Pat. No. 4,244,116 describes the use of a one dual axis inertial angular rate sensor having its spin axis parallel to the borehole axis and one dual axis accelerometer for survey in a well of borehole. In this case no provision is made for rotation of the sensors about the borehole axis. U.S. patent application Ser. No. 338,261, filed Jan. 11, 1982 describes the use of one or more magnetic field vector sensors in combination with one or more acceleration sensors for survey with respect to the earth's magnetic field vector in a way related to the sensors of U.S. Pat. Nos. 3,753,296 and 4,199,869 which survey with respect to the earth's inertial angular rate vector.

The referenced patents and application describe the sensing equipments and show provisions to compute the output desired azimuth indication, but none of them show or teach the method and means described herein for obtaining the desired output, nor do they show the essential use of the output of the acceleration sensor (or sensors) to resolve the output (or outputs) of either the inertial angular rate sensor (or sensors) or the magnetic field sensor (or sensors) into a known coordinate system. For example, U.S. Pat. No. 4,244,116 shows a computation of:

$$\Omega_Z = \sqrt{E^2 - \Omega_x^2 - \Omega_y^2}$$

where

E=Vector of the earth rotation $\Omega_z$=Component of E along the borehole $\Omega_x$, $\Omega_y$=Gyro outputs normal to the borehole, and states "the measurement $\Omega_x$ and $\Omega_y$ and the calculation of $\Omega_z$ give then the azimuth of the drilling line". This is in general not true since $\Omega_x$ and $\Omega_y$ are known only to be perpendicular to the drilling line, but are not known in a known earth fixed coordinate set.

SUMMARY OF THE INVENTION

It is a major purpose of this invention to provide method and means to use data from the acceleration sensor (or sensors) in a mapping or survey tool to determine the orientation of the inertial angular rate or magnetic field vector sensor (or sensors) with respect to a known earth fixed coordinate set so that correct azimuth determination can be made. It is a second purpose of this invention to provide method and means for azimuth determination in a completely explicit non-ambiguous manner once the sensor data has been resolved to a known earth fixed coordinate set.

The determination of azimuth with respect of either the earth's inertial angular velocity vector (so called true azimuth) or earth's magnetic field vector (so called magnetic azimuth) requires that one first determine at least one (but for complete all azimuths two orthogonal) component of the desired reference vector (angular velocity or magnetic) in a plane parallel to the earth's surface and in a known orientation to the desired unknown azimuth direction. In mapping or survey apparatus of the types cited as previously used in wells or boreholes, the reference direction vector sensors, either inertial angular rate or magnetic, provide outputs proportional to the vector dot product of vectors along their input sensitive axes and the reference vectors. Such outputs of themselves provide no means to know the components of the reference direction vector in a horizontal plane. However, an acceleration sensor (sensors) at a fixed location in the well or borehole provides direct knowledge of the relation of its input axis of sensitivity with respect to the local gravity vector which by definition is normal to the horizontal plane. Since the orientation of the input axis of sensitivity of the reference direction vector sensor, either angular rate or magnetic, is known with respect to the input axis of sensitivity of the acceleration sensor, the output of the acceleration sensor (or sensors) thus may be used to process the output (or outputs) of the reference direction vector sensor (or sensors) to determine one or more components in the horizontal plane.

Accordingly, it is a major object of the invention to provide borehole survey apparatus wherein angular rate sensor means and acceleration sensor means are suspended and effectively rotated in a borehole, the angular rate sensor means having amplitude output GA and rotation related phase output GP, and the acceleration sensor means having amplitude output AA and rotation related phase output AP, there also being means supplying a signal value $\Omega_v$ proportional to the local vertical component of the earth's angular rate of rotation, the improvement which comprises (a) first means for combining AA, AP, GA, GP and $\Omega_v$ to derive a value $\psi$ for borehole azimuth at the level of the sensor means in the borehole.

In addition, the invention provides means operatively connected with said first means for employing AA to derive a value $\phi$ for borehole tilt from vertical at the level of said sensor means in the borehole.

The basic method of the invention involves the method of borehole mapping or surveying using a single angular rate sensor and a single acceleration sensor, both with input axes of sensitivity nominally normal to the borehole axis, the sensors being effectively rotated about the borehole axis, the sensors having outputs, the steps that include:

(a) employing the acceleration sensor output together with the inertial angular rate sensor output to derive from the rate sensor output two components respectively in a horizontal plane, one normal to the plane containing the borehole axis and the gravity vector, and the other in that plane, and deriving borehole azimuth from said component in a horizontal plane.

These and other objects and advantages of the invention, as well as the details of an illustrative embodiment, will be more fully understood from the following specification and drawings, in which:

DRAWING DESCRIPTION

FIG. 1 is a geometrical depiction of a reference co-ordinate system established at the start of borehole drilling;

FIG. 1*a* relates the FIG. 1 co-ordinate system to an instrument level co-ordinate system in a borehole;

FIG. 2. shows plots of single axis accelerometer and gyroscope outputs vs instrument rotation angle FIG. 3 is a geometrical showing of vector relationships in a borehole;

FIG. 4 is a circuit block diagram;

FIG. 9 is an elevation taken in section to show one form of instrumentation employing the invention;

FIG. 10 is an elevation showing use of the FIG. 9 instrumentation in multiple modes, in a borehole.

DETAILED DESCRIPTION

Figure 3:
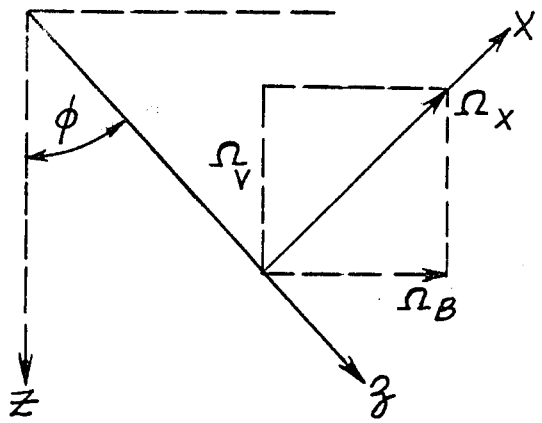

Referring first to FIG. 9, a carrier such as elongated housing 10 is movable in a borehole indicated at 11, the hole being cased at 11*a*. Means such as a cable to travel the carrier lengthwise in the hole is indicated at 12. A motor or other manipulatory drive means 13 is carried by and within the carrier, and its rotary output shaft 14 is shown as connected at 15 to an angular rate sensor means 16. The shaft may be extended at 14*a*, 14*b* and 14*c* for connection to first acceleration sensor means 17, second acceleration sensor means 18, and a resolver 19. The accelerometers 17 and 18 can together be considered as means for sensing tilt. These devices have terminals 16*a*–19*a* connected via suitable slip rings with circuitry indicated at 29 carried within the carrier (or at the well surface, if desired).

The apparatus operates for example as described in U.S. Pat. No. 3,753,296 and as described above to determine the azimuthal direction of tilt of the borehole at a first location in the borehole. See for example first location indicated at 27 in FIG. 2. Other U.S. Patents describing such operation are U.S. Pat. Nos. 4,199,869, 4,192,077 and 4,197,654. During such operation, the motor 13 rotates the sensor 16 and the accelerometers either continuously, or incrementally.

The angular rate sensor 16 may for example take the form of one or more of the following known devices, but is not limited to them:

1. Single degree of freedom rate gyroscope
2. Tuned rotor rate gyroscope
3. Two axis rate gyroscope
4. Nuclear spin rate gyroscope
5. Sonic rate gyroscope
6. Vibrating rate gyroscope
7. Jet stream rate gyroscope
8. Rotating angular accelerometer
9. Integrating angular accelerometer
10. Differential position gyroscopes and platforms
11. Laser gyroscope
12. Combination rate gyroscope and linear accelerometer Each such device may be characterized as having a "sensitive" axis, which is the axis about which rotation occurs to produce an output which is a measure of rate-of-turn, or angular rate $\omega$. That value may have components $\omega_1$, $\omega_2$ and $\omega_3$ in a three axis co-ordinate system. The sensitive axis may be generally normal to the axis 20 of instrument travel in the borehole.

The acceleration sensor means 17 may for example take the form of one or more of the following known devices; however, the term "acceleration sensor means" is not limited to such devices:

1. one or more single axis accelerometers
2. one or more dual axis accelerometers
3. one or more triple axis accelerometers Examples of acceleration sensors include the accelerometers disclosed in U.S. Pat. Nos. 3,753,296 and 4,199,869, having the functions disclosed therein. Such sensors may be supported to be orthogonal to the carrier axis. They may be stationary or carouseled, or may be otherwise manipulated, to enhance accuracy and/or gain an added axis or axes of sensitivity. The axis of sensitivity is the axis along which acceleration measurement occurs.

Figure 11:
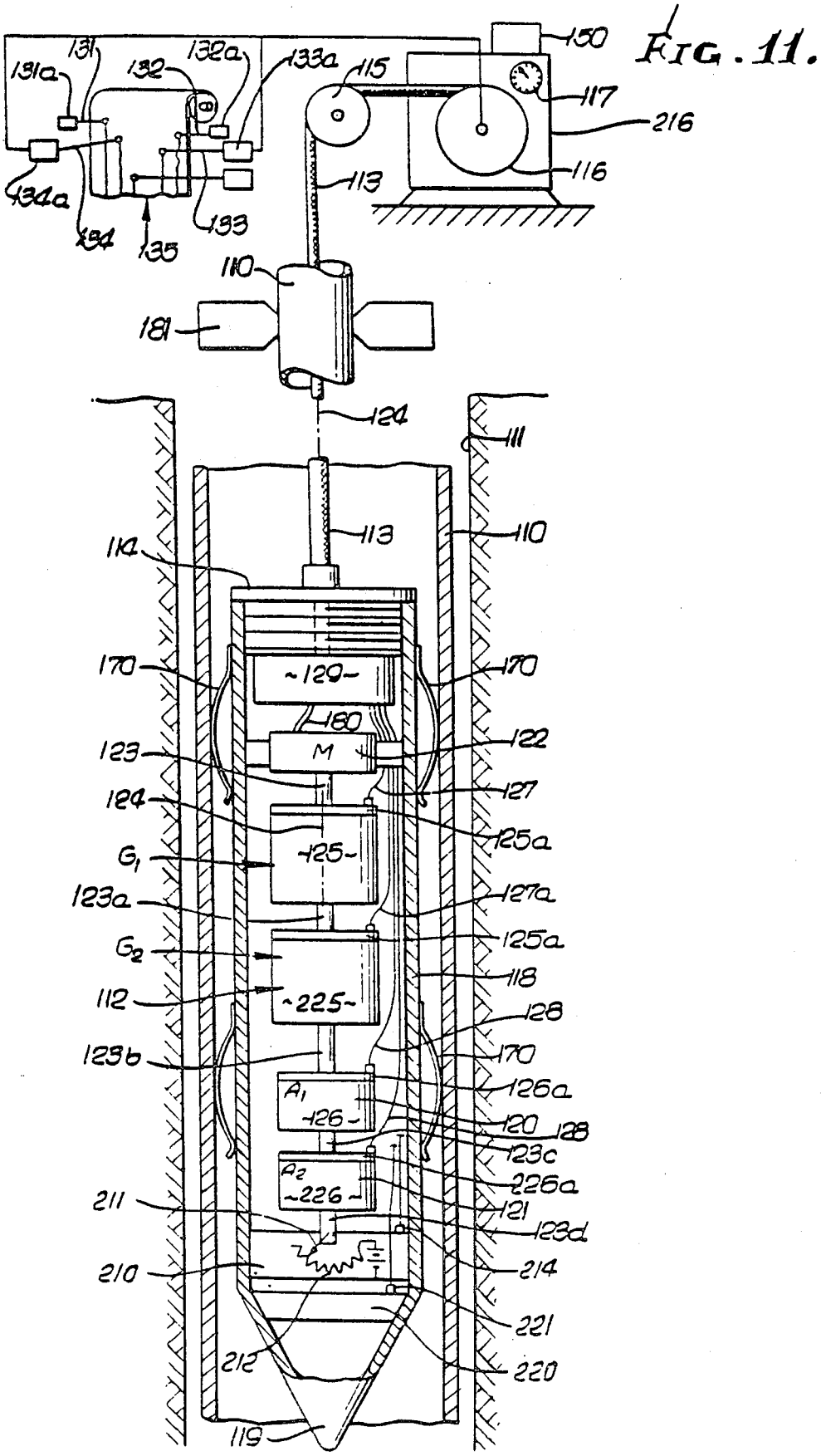
FIG. 11 is a vertical section showing further details of the FIG. 9 apparatus as used in a borehole.

FIG. 11 shows in detail dual input axis rate sensor means and dual output axis accelerometer means, and associated surface apparatus. In FIG. 11, well tubing 110 extends downwardly in a well 111, which may or may not be cased. Extending within the tubing is a well mapping instrument or apparatus 112 for determining the direction of tilt, from vertical, of the well or borehole. Such apparatus may readily be traveled up and down in the well, as by lifting and lowering of a cable 113 attached to the top 114 of the instrument. The upper end of the cable is turned at 115 and spooled at 116, where a suitable metter 117 may record the length of cable extending downwardly in the well, for logging purposes.

The apparatus 112 is shown to include a generally vertically elongated tubular housing or carried 118 of diameter less than that of the tubing bore, so that well fluid in the tubing may readily pass, relatively, the instrument as it is lowered in the tubing. Also, the lower terminal of the housing may be tapered at 119, for assisting downward travel or penetration of the instrument through well liquid in the tubing. The carrier 118 supports first and second angular sensors such as a rate gyroscopes $G_1$ and $G_2$, and accelerometers 120 and 121, and drive means 122 to rotate the latter, for travel lengthwise in the wall. Bowed springs 170 on the carrier center it in the tubing 110.

The drive means 122 may include an electric motor and speed reducer functioning to rotate a shaft 123 relatively slowly about a common axis 124 which is generally parallel to the length axis of the tubular carrier, i.e. axis 124 is vertical when the instrument is vertical, and axis 124 is tilted at the same angle form vertical as is the instrument when the latter bears sidewardly against the bore of the tubing 110 when such tubing assumes the same tilt angle due to borehole tilt from vertical. Merely as illustrative, for the continuous rotation case, the rate of rotation of shaft 124 may be within the range 0.5 RPM to 5 RPM. The motor and housing may be considered as within the scope of means to support and rotate and gyroscope and accelerometers.

Due to rotation of the shaft 123, and lower extensions 123*a*, 123*b* and 123*c* thereof, the frames 125 and 225 of the gyroscopes and the frames 126 and 226 of the accelerometers are typically all rotated simultaneously about axis 124, within and relative to the sealed housing 118. The signal outputs of the gyroscopes and accelerometers are transmitted via terminals at suitable slip ring structures 125*a*, 225*a*, 126*a* and 226*a*, and via cables 127, 127*a*, 128 and 128*a*, to the processing circuitry at 129 within the instrument, such circuitry for example including that to be described, and multiplexing means if desired. The multiplexed or non-multiplexed output from such circuitry is transmitted via a lead in cable 113 to a surface recorder, as for example include pens 131–134 of a strip chart recorder 135, whose advancement may be synchronized with the lowering of the instrument in the well. The drivers 131*a*—134*a* for recorder pens 131–134 are calibrated to indicate borehole azimuth, degree of tilt and depth, respectively, and another strip chart indicating borehole depth along its length may be employed, if desired. The recorder can be located at the instrument for subsequent retrieval and read-out after the instrument is pulled from the hole.

The angular rate sensor 16 may take the form of gyroscope $G_1$ or $G_2$, or their combination, as described in U.S. Pat. No. 4,199,869. Accelerometers 126 and 226 correspond to 17 and 18 in FIG. 9.

Consider now a reference coordinate system is established at the start of the borehole such that $\underline{\overline{X}}$ is parallel to the earth surface and North, $\underline{\overline{Y}}$ is parallel to the earth surface and East, and Z is perpendicular to the earth surface and Down. The starting point is at latitude $\lambda$ and FIG. 1 shows the basic geometry.

From this starting reference, the bore axis is defined as rotated through an azimuth angle $\psi$ clockwise about Z, followed by a rotation $\phi$ about the new $\underline{\overline{Y}}$ axis to obtain a bore axis reference coordinate set in the bore such that z is downward along the bore axis, y is parallel to the earth surface, and x lies perpendicular to y and z. Also, as will be seen, x is in the vertical plane containing the gravity vector and the borehole axis z. See also FIG. 1*a*.

It may be shown that the direction cosine matrix relating this bore axis reference set to the starting reference set is as shown below:

| | | co-ord set at surface | | |
|---|---|---|---|---|
| | | $\overline{X}$ | $\overline{Y}$ | Z |
| Co-ord Set in Bore Hole | x | $C\psi C\phi$ | $S\psi C\phi$ | $-S\phi$ |
| | y | $-S\psi$ | $C\psi$ | 0 |
| | z | $C\psi S\phi$ | $S\psi S\phi$ | $C\phi$ |

In the above C represents Cosine, S represents Sine.

There is no direct way to measure all three direction cosines relating z to the fixed (starting) reference set. However, gyroscopic and acceleration sensing devices can be used to sense quantities from which the required coefficients can be calculated.

The earth rate rotation vector, $\overline{\Omega}$, in reference coordinates is $$\overline{\Omega}=\Omega_H\overline{1}_z-\Omega_v\overline{1}_z \tag{1}$$

where $\Omega_H=\Omega C\lambda$, the horizontal component, $\Omega_v=\Omega S\lambda$, the vertical component, and the earth's gravity vector, g, in reference coordinates is $$\overline{g}=-g\overline{1}_z. \tag{2}$$

In the above expression the symbol $\overline{1}_N$ is a unit vector in the N direction.

The components of $\overline{\Omega}$ and $\overline{g}$ in the bore axis reference set can be found by forming the dot products $\overline{1}_x\cdot\overline{\Omega}$, $\overline{1}_y\cdot\overline{\Omega}$, $\overline{1}_z\cdot\Omega$ and $\overline{1}_x\cdot\overline{g}$, $\overline{1}_y\cdot\overline{g}$, and $\overline{1}_z\cdot\overline{g}$ The results of these operations are:

$$gx=gS\phi \tag{3}$$

$$gy=0 \tag{4}$$

$$gz=-gC\phi \tag{5}$$

$$\Omega x=\Omega_H C\psi C\phi+\Omega_v S\phi \tag{6}$$

$$\Omega y=-\Omega_H S\psi \tag{7}$$

$$\Omega z=\Omega_H C\psi S\phi-\Omega_v C\phi \tag{8}$$

Ideally, three accelerometers and three gyro sensing axes could determine all of the required information with no ambiguities or unusual sensitivities other than the classical and well known increased sensitivity to gyro error as latitude increases toward the polar axis.

Figure 7:
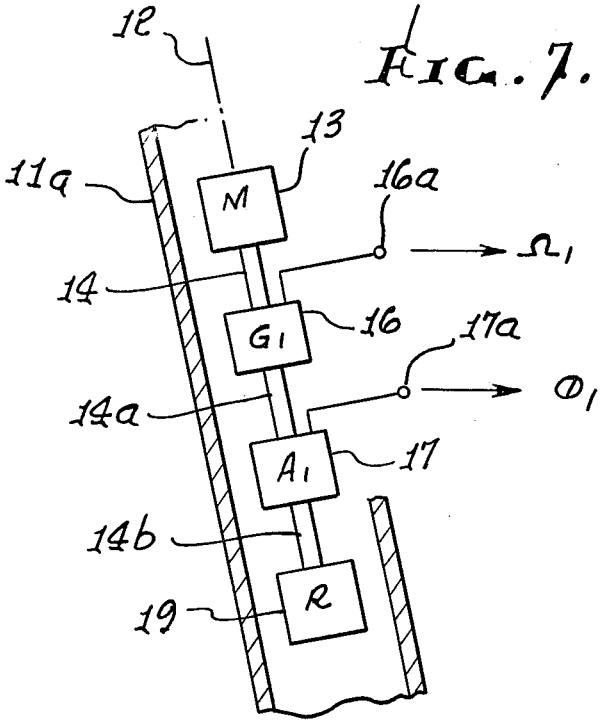
FIG. 7 shows intrumentation in a borehole (single axis angular rate sensor, and single axis accelerometer)
Figure 8:
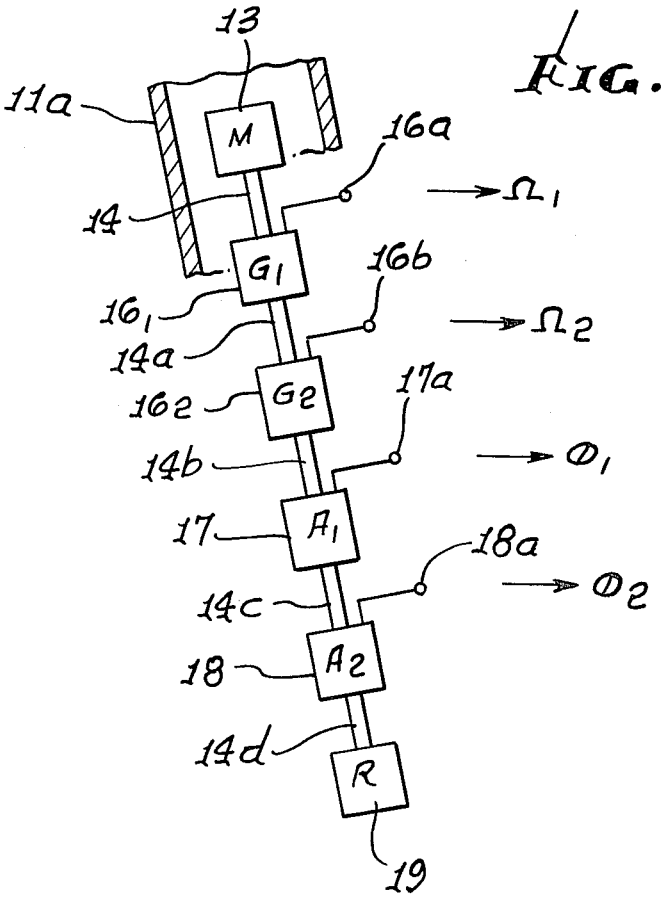
FIG. 8 shows instrumentation in a borehole (dual axis angular rate sensor, and dual axis accelerometer)

As shown by the earlier cited patents, to reduce the size and system complexity, sufficient information may be obtained by either a single axis gyro and single axis accelerometer rotated such that their input axes are swept about the x, y plane (normal to the bore axis) or by a two axis gyro and two axis accelerometer having their input axes in the x, y plane. FIG. 7 shows such a single axis gyro G and single axis accelerometer A (see also 16 and 17 in FIG. 9); and FIG. 8 shows such a two axis gyro $G_1$ and $G_2$ and two axis accelerometer $A_1$ and $A_2$ (see also FIG. 11).

If single axis instruments are used, the plot of their outputs vs rotation angle will appear as (in the absence of sensor errors) shown in FIG. 2.

In this figure, it is evident that the accelerometer output is a sinusoid having its peak output at the point where the input sensitive axis is parallel to the x axis, where x was as previously defined to be in the vertical plane containing the gravity vector and the borehole axis. If the phase angle $\alpha$, between the accelerometer peak output and the gyro peak output is measured by suitable signal processing, it is then possible to compute $\Omega_x$, the component of the earth rotation vector in the vertical plane containing the borehole axis and the earth's gravity vector, and $\Omega_y$, the component of the earth rotation vector in the horizontal plane (normal to the gravity vector). Such components are:

$$\Omega_x=\sqrt{\Omega_x^2+\Omega_y^2}\cos\alpha \tag{9}$$

$$\Omega_y=\sqrt{\Omega_x^2+\Omega_y^2}\sin\alpha \tag{10}$$

From the previously shown mechanization that $\Omega_y$ was equivalent to:

$$\Omega_y=-\Omega_H\sin\psi \tag{11}$$

it would be possible to compute azimuth as:

$$\psi = \text{Arc sin}\frac{\Omega_y}{\Omega_H} \tag{12}$$

using the value of $\Omega_y$ computed from the gyro output and the phase angle between the gyroscope output and the accelerometer output. This displays the essential usage of the accelerometer output to determine a component of the earth's inertial angular rate vector in a horizontal plane.

The method shown above is suitable except that for azimuths near 90° (East) or 270° (West) the arcsin function provides very poor sensitivity since the rate of change of sin $\psi$ with $\psi$ is very low in these regions. This would lead to large errors in azimuth from small sensor errors. It is, therefore, desirable to find another component of the earth's inertial angular rotation vector in the horizontal plane. FIG. 3 shows a side view of the borehole along the previously defined y axis.

The value of the measured component $\Omega_x$ is by inspection:

$$\Omega_x = \Omega_v \sin\phi + \Omega_B \cos\phi \tag{13}$$

Since $\Omega_x$ has been determined from the gyro output and the accelerometer to gyro phase angle, and since $\phi$ can be determined from the amplitude of the accelerometer signal as:

$$\phi = \text{Arc sin}\left(\frac{A\ \text{AMPLITUDE}}{g}\right) \tag{14}$$

Then $$\Omega_B = \frac{\Omega_x - \Omega_v \sin\phi}{\cos\phi} \tag{15}$$

But as previously defined;

$$\Omega_x = \Omega_H C\psi C\phi + \Omega_v S\phi \tag{16}$$

so that $$\Omega_B = \Omega_H C\psi \tag{17}$$

From this it is possible to compute:

$$\psi = \text{Arc cos}\frac{\Omega_B}{\Omega_H} \tag{18}$$

This mechanization also provides a value of $\psi$ and since it is based on a arccos vs the previously cited arcsin function, the region of poor sensitivity is near azimuth of 0° (North) or 180° (South). This again shows the essential use of the accelerometer output to properly resolve the gyro output into the horizontal plane. If one desires, these two functions can be combined into one which has no regions of poor sensitivity. Such a form is:

$$-\psi = \text{Arc tan}\frac{\Omega_y/\Omega_H}{\Omega_B/\Omega_H} \tag{19}$$

$$= \text{Arc tan}\frac{\Omega_y}{\Omega_B} \tag{20}$$

FIG. 4 shows a complete block diagram of the described mechanization. As the combination of sensing devices is rotated about its rotation axis in a borehole, both the inertial angular rate sensing and acceleration sensing devices will produce variable output indications proportional to the vector dot product of a unit vector along the respective input axis and the local earth rotation vector and gravity vector respectively. For continuous rotation operation at a fixed location in the borehole these signals will be sinusoidal in nature. For discrete step rotation, the sensor outputs will be just the equivalent of sampling points on the above mentioned sinusoidal signals. Thus, from a knowledge of sample point amplitudes and position along the sinusoid, the character of an equivalent sinusoid in amplitude and phase may be determined. For either continuous rotation or discrete positioning, the quantities that must be determined are the gyro signal amplitude GA (GAMPLITUDE), the accelerometer signal amplitude AA (AAMPLITUDE), and the phase angle between the peak values of these two signals, $\alpha$. FIG. 4 shows the two sensor signals, after required scaling, and a reference time or angle signal as inputs to the two blocks labeled "Sinusoid Amplitude and Phase." Each of these blocks finds the amplitude of the input sinusoid and the phase angle between the input signal and the reference derived from the rotation drive function. The outputs of the upper block are gyro amplitude and phase, labelled GA (GAMPLITUDE) and GP (GPHASE). The outputs of the lower block are accelerometer amplitude and phase, labelled AA (AMPLITUDE) and AP (APHASE). These amplitude functions are then directly input to subsequent elements and the required phase difference $\alpha$, is shown, GPHASE minus APHASE.

Figure 5:
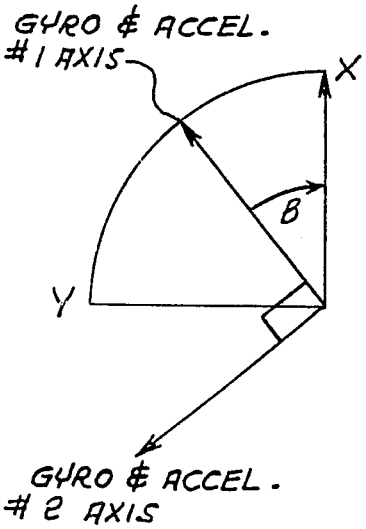
FIG. 5 is a coordinate system diagram.

If a two axis gyro and two axis accelerometer are used, allowance must be made for unknown rotation about the bore axis. FIG. 5 shows a view looking at the x, y plane from the positive z side.

The sensed accelerometer outputs in terms of the gravity components $g_x = g \sin\phi$ and $g_y = 0$ are:

$$g_1 = g_x \cos\beta \tag{21}$$

$$g_2 = -g_x \sin\beta \tag{22}$$

The sensed angular rates for the two gyro outputs are:

$$\Omega_1 = \Omega_x \cos\beta + \Omega_y \sin\beta \tag{23}$$

$$\Omega_2 = -\Omega_x \sin\beta + \Omega_y \cos\beta \tag{24}$$

From the accelerometer data $$\beta = \text{Arc tan}\frac{-g_2}{g_1} \tag{25}$$

$$g_x = \sqrt{g_1^2 + g_2^2} = A\ \text{AMPLITUDE} \tag{26}$$

Using the value of $\beta$ determined above from the accelerometer data and the sensed outputs of the two gyros, two components of the gyro output $\Omega_x$ and $\Omega_y$ in a known coordinate set may be computed as:

$$\Omega_x = \Omega_1 \text{Cos}\,\beta - \Omega_2 \sin\beta \tag{27}$$

$$\Omega_y = \Omega_1 \sin\beta + \Omega_2 \cos\beta \tag{28}$$

Figure 6:
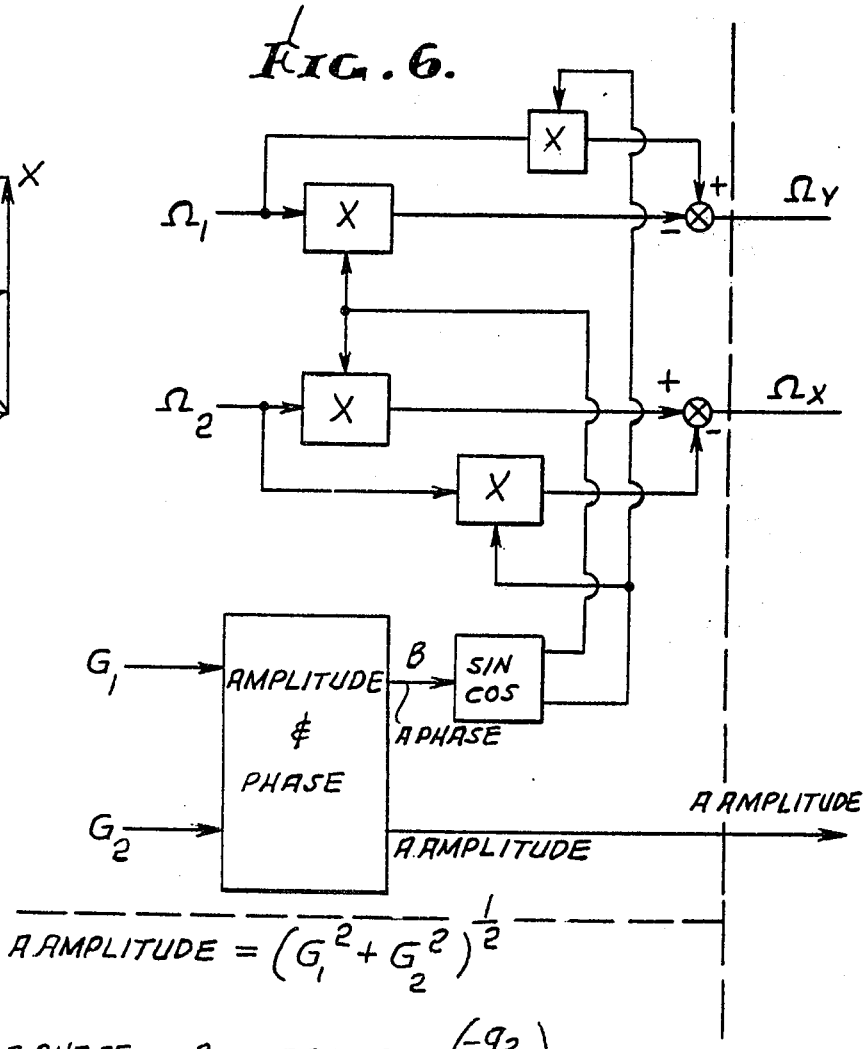
FIG. 6 is a circuit block diagram.

These values are then identical to the AAMPLITUDE, $\Omega_x$, and $\Omega_y$ previously described for the rotated single axis case and the value of azimuth may be determined in the same way. FIG. 6 shows a complete block diagram of circuitry to perform this determination. In FIG. 6, the differences in signal processing for the two angular rate inputs and the two acceleration inputs compared to one rotated sensor of each kind are as shown in FIG. 4. The portion to the left of the dotted line in FIG. 6 would be substituted for the corresponding portion of FIG. 4. Note that since there are two nominally orthogonal signals of each kind, no reference time or angle input is required. Again, the essential use of acceleration sensor outputs to resolve the angular rate sensor data to a known coordinate system is shown.

Although the previous description has used the earth's inertial angular rate vector as the reference direction vector, the earth's magnetic field vector can be used as a reference if magnetic vector sensors replace angular velocity sensors, as in the drawings. All that is necessary is to substitute $M_H$ and $M_V$ for $\Omega_H$ and $\Omega_v$, $M_x$ and $M_y$ for $\Omega_x$ and $\Omega_y$, and $M_B$ for $\Omega_B$. In these formulations the various components of the earth's magnetic field vector are used and the resulting azimuth is the magnetic azimuth measured with respect to the horizontal component of the earth's magnetic field. The same essential dependence on the acceleration sensors, for the resolution of the magnetic sensor outputs into a horizontal plane, is evident in this usage.

Referring now in detail to FIG. 4, the angular rate sensor (gyroscope) amplitude and phase outputs are indicated at GA and GP. These are typically in voltage signal form. Similarly, the accelerometer amplitude and phase outputs are indicated at AA and AP. A synchronizing reference time or angle signal is supplied at 150 to the amplitude and phase detectors 148 and 149 which respond to the gyroscope and accelerometer outputs to produce GA, GP, AP and AA. Means is also provided to supply at 151 a signal corresponding to earth's rotation rate $\Omega$, and to supply at 152 a signal corresponding to the borehole latitude $\lambda$. A sin/cos generator 153 operates on signal 152 to produce the output sin $\lambda$ at 154. The latter and signal 151 are supplied to multiplier 155 whose output $\Omega \cdot \sin \lambda = \Omega_v$ appears on lead 156.

In accordance with the invention, (a) first means is provided for combining (or operating upon) AA, AP, GA, GP and $\Omega_v$ to derive a value $\psi$ for borehole azimuth at the level of the sensors suspended in the borehole. The azimuth signal $\psi$ appears on lead 157 at the right of the circuitry shown. In addition, (b) second means is operatively connected with the referenced first means for employing AA to derive a signal value $\phi$ representative of borehole tilt from vertical, at the level of the sensor means in the borehole.

More specifically, such (a) first means include (c) means responsive to GA, GP and AP to derive:

(i) a first component $\Omega_x$ of the angular rate sensor output, and (ii) a second component $\Omega_y$ of the angular rate sensor output.

See $\Omega_v$ on lead 158, and $\Omega_y$ on lead 159. Such (c) means may typically include:

(d) means responsive to GP and AP to produce a phase angle value or signal $\alpha$ representative of the difference in phase of the GP and AP signals (see for example the subtractor 159*a* connected with the output sides of 148 and 149, the subtractor output $\alpha$ appearing on lead 160), (e) means responsive to $\alpha$ to produce signal values sin $\alpha$ and cos $\alpha$ (see for example the sin/cos generator 161 whose input side is connected with lead 160, and whose outputs sin $\alpha$ and cos $\alpha$ appear on leads 162 and 163), (f) means responsive to GA and cos $\alpha$ to multiply same and produce the signal value $\Omega_x$ (see for example the multiplier 164 whose inputs are connected with GA lead 165 and cos $\alpha$ lead 163), (g) means responsive to GA and sin $\alpha$ to multiply same and produce the signal value $\Omega_y$ (see for example multiplier 166 whose inputs are connected with the GA input and with sin $\alpha$ lead 112).

The (a) first means also includes (h) means responsive to $\Omega_x$, AA and $\Omega_v$ to derive a value $\Omega_B$ and (j) means responsive to $\Omega_y$ and $\Omega_B$ to derive the said value $\psi$ for borehole azimuth. For example, the (h) means may include:

($h_1$) an arcsin generator 170 responsive to AA (supplied on lead 171 from detector 149) to generate output at 172, ($h_2$) sin/cos generator 173 connected with output 172 to produce output sin $\phi$, on lead 174 and output cos $\phi$ on lead 175, ($h_3$) multiplier 176 responsive to sin $\phi$ on lead 174 and $\Omega_v$ on lead 156 to produce their product on output lead 177, ($h_4$) subtractor 178 connected with leads 177 and 158 to produce the value ($\Omega_x - \Omega_v \sin \phi$) on lead 179

($h_5$) a divider 180 to divide the values on leads 179 and 175 and produce the desired values $\Omega_B$ on lead 181.

The (i) means referred to above is shown in FIG. 4 to include an arc tangent generator 182 connected with leads 159 and 181 to be responsive to $\Omega_y$ and $\Omega_B$ to produce the $\psi$ output proportional to arctan ($-\Omega_y/\Omega_B$). The tilt output signal $\phi$ is produced on lead 184 connected with the output of arcsin generator 170.

FIG. 6 shows similar connections and circuit elements responsive to inputs $\Omega_1$ and $\Omega_2$ from two gyroscopes (or dual axis gyroscope) and inputs $\mathcal{O}_1$ and $\mathcal{O}_2$ from two accelerometers (or from a dual axis accelerometer), to produce the values $\Omega_y$, $\Omega_x$ and AA, which are then processed as in FIG. 4. See also FIG. 8.

The above operational devices as at 148, 149, 159, 178, 155, 164, 166, 180, 153, 161, 173, 170 and 182 may be analog or digital devices, or combinations thereof.

Referring to FIG. 10, the determinations of azimuth $\psi$ and tilt $\phi$ are carried out at multiple locations in a borehole, as at 27, 27' and 27''; and they may be carried out at each such location during cessation of elevation or lowering by operation of cable 12, or during such elevation or lowering.

We claim:

1. In the method of borehole mapping or surveying using a single angular rate sensor and a single acceleration sensor, both with input axes of sensitivity nominally normal to the borehole axis, the sensors being effectively rotated about the borehole axis; the sensors having outputs, the step that includes:

(a) employing the acceleration sensor output together with the inertial angular rate sensor output to derive from the rate sensor output two components respectively in a horizontal plane normal to the plane containing the borehole axis and the gravity vector, and in a vertical plane, and deriving borehold azimuth from said component in a horizontal plane and from a known component in said horizontal plane of the earth's angular velocity vector.

2. In the method of borehole mapping or surveying using a single angular rate sensor and a single acceleration sensor, both with input axes of sensitivity nominally normal to the borehole axis, the sensors being effectively rotated about the borehole axis; the sensors having outputs, the step that includes:

(a) employing the acceleration sensor output together with the inertial angular rate sensor output to derive from the rate sensor output two components respectively in a horizontal plane normal to the plane containing the borehole axis and the gravity vector, and in a vertical plane, and deriving borehole azimuth from said component in a horizontal plane and from a known component in said horizontal plane of the earth's angular velocity vector, (b) said derivation of azimuth includes deriving the arcsin of said component in the horizontal plane normal to the plane containing the borehole axis divided by the component in said horizontal plane of the earth's angular velocity vector, which value is representative of borehole azimuth.

3. The method of claim 1 including employing the acceleration sensor output to derive from the output of the angular rate sensor the component of the earth's rotation rate in the horizontal plane at its intersection with the vertical plane containing the gravity vector and the borehole axis.

4. In the method of borehole mapping or surveying using a single angular rate sensor and a single acceleration sensor, both with input axes of sensitivity nominally normal to the borehole axis, the sensors being effectively rotated about the borehole axis; the sensors having outputs, the step that includes:

(a) employing the acceleration sensor output together with the inertial angular rate sensor output to derive from the rate sensor output two components respectively in a horizontal plane normal to the plane containing the borehole axis and the gravity vector, and in a vertical plane, and deriving borehole azimuth from said component in a horizontal plane and from a known component in said horizontal plane of the earth's angular velocity vector, (b) and employing the acceleration sensor output to derive from the output of the angular rate sensor the component of the earth's rotation rate in the horizontal plane at its intersection with the vertical plane containing the gravity vector and the borehole axis, (c) said derivation of azimuth being a derivation of the arccos of the component derived in (b) above divided by said horizontal plane component, which value is representative of borehole azimuth.

5. In the method of borehole mapping or surveying using a single angular rate sensor and a single acceleration sensor, both with input axes of sensitivity nominally normal to the borehole axis, the sensors being effectively rotated about the borehole axis; the sensors having outputs, the step that includes:

(a) employing the acceleration sensor output together with the inertial angular rate sensor output to derive from the rate sensor output two components respectively in a horizontal plane normal to the plane containing the borehole axis and the gravity vector, and in a vertical plane, and deriving borehole azimuth from said component in a horizontal plane and from a known component in said horizontal plane of the earth's angular velocity vector, (b) said derivation of azimuth being a derivation of the arctan of a value $x_1$ divided by a value $x_2$, where $x_1$ is said component in the horizontal plane divided by the component in the horizontal plane of the earth's angular velocity vector, and $x_2$ is the component of the earth's rotation rate in the horizontal plane at its intersection with the vertical plane containing the gravity vector and the borehole axis.

6. The method of borehole mapping or surveying using two axis inertial angular rate sensor means and two axis acceleration sensor means, each having outputs, both with their two input axes of sensitivity nominally normal the borehole axis; the sensor means being effectively rotated about the borehole axis, the sensor means having outputs, the steps that include (a) employing the acceleration sensor outputs together with the inertial angular rate sensor outputs to derive from the rate sensor outputs components in a horizontal plane normal to the plane containing the borehole axis and the gravity vector, and in a vertical plane, and deriving borehole azimuth from said component in a horizontal plane and from a known component in said horizontal plane of the earth's angular velocity vector.

7. The method of borehole mapping or surveying using two axis inertial angular rate sensor means and two axis acceleration sensor means, each having outputs, both with their two input axes of sensitivity nominally normal the borehole axis; the sensor means being effectively rotated about the borehole axis, the sensor means having outputs, the steps that include (a) employing the acceleration sensor outputs together with the inertial angular rate sensor outputs to derive from the rate sensor outputs components in a horizontal plane normal to the plane containing the borehole axis and the gravity vector, and in a vertical plane, and deriving borehole azimuth from said component in a horizontal plane and from a known component in said horizontal plane of the earth's angular velocity vector, (b) said last derivation including deriving a value of the arcsin of said component in the horizontal plane divided by said component in said horizontal plane of the earth's angular velocity vector, which value is representative of borehole azimuth.

8. The method of claim 6 including employing the acceleration sensor output to derive from the output of an angular rate sensor the component of the earth's rotation rate in the horizontal plane at its intersection with the vertical plane containing the gravity vector and the borehole axis.

9. The method of borehole mapping or surveying using two axis inertial angular rate sensor means and two axis acceleration sensor means, each having outputs, both with their two input axes of sensitivity nominally normal to the borehole axis; the sensor means being effectively rotated about the borehole axis, the sensor means having output, the steps that include (a) employing the acceleration sensor outputs together with the inertial angular rate sensor outputs to derive from the rate sensor outputs components in a horizontal plane normal to the plane containing the borehole axis and the gravity vector, and in a vertical plane, and deriving borehole azimuth from said component in a horizontal plane and from a known component in said horizontal plane of the earth's angular velocity vector, (b) and employing the acceleration sensor output to derive from the output of an angular rate sensor the component of the earth's rotation rate in the horizontal plane at its intersection with the vertical plane containing the gravity vector and the borehole axis, (c) said derivation of azimuth being a derivation of the arccos of the component derived in (b) above divided by said horizontal plane component which value is representative of borehole azimuth.

10. The method of borehole mapping or surveying using two axis inertial angular rate sensor means and two axis acceleration sensor means, each having outputs, both with their two input axes of sensitivity nominally normal the borehole axis; the sensor means being effectively rotated about the borehole axis, the sensor means having outputs, the steps that include (a) employing the acceleration sensor outputs together with the inertial angular rate sensor outputs to derive from the rate sensor outputs components in a horizontal plane normal to the plane containing the borehole axis and the gravity vector, and in a vertical plane, and deriving borehole azimuth from said component in a horizontal plane and from a known component in said horizontal plane of the earth's angular velocity vector, (b) said derivation of azimuth being a derivation of the arctan of a value $x_1$ divided by a value $x_2$, where $x_1$ is said component in the horizontal plane divided by the component in said horizontal plane of the earth's angular velocity vector, and $x_2$ is the component of the earth's rotation rate in the horizontal plane at its intersection with the vertical plane containing the gravity vector and the borehole axis.

11. The method of either one of claims 1 and 6 wherein the inertial angular rate sensor or sensors are replaced by magnetic field vector sensors and magnetic azimuth is derived.

12. The method of either one of claims 1 and 6 wherein the indicated derivations are carried out by operation of analog computation elements.

13. The method of either one of claims 1 and 6 wherein the indicated derivations are carried out by operation of digital computation elements.

14. The method of either one of claims 1 and 6 wherein the indicated derivations are carried out by operation of a combination of analog and digital computation elements.

15. In borehole survey apparatus wherein angular rate sensor means and acceleration sensor means are suspended and effectively rotated in a borehole, the angular rate sensor means having amplitude output GA and rotation related phase output GP, and the acceleration sensor means having amplitude output AA and rotation related phase output AP, there also being means supplying a signal value $\Omega_v$ proportional to earth's angular rate of rotation, the improvement which comprises (a) first means for combining AA, AP, GA, GP and $\Omega_v$ to derive a value $\psi$ for borehole azimuth at the level of said sensor means in the borehole.

16. The apparatus of claim 15 including (b) second means operatively connected with said first means for employing AA to derive a value $\phi$ for borehole tilt from vertical at the level of said sensor means in the borehole.

17. The apparatus of claim 15 wherein said first means includes (c) means responsive to GA, GP and AP to derive (i) a first component $\Omega_x$ of the angular rate sensor output, and (ii) a second component $\Omega_y$ of the angular rate sensor output.

18. The apparatus of claim 17 wherein said (c) means to derive $\Omega_x$ and $\Omega_y$ includes (d) means responsive to GP and AP to produce a phase angle value $\alpha$ representative of the difference in phase of said GP and AP outputs, (e) means responsive to $\alpha$ to produce sin $\alpha$ and cos $\alpha$ values, (f) means to multiply GA and said sin $\alpha$ value to produce $\Omega_y$, and (g) means to multiply GA and said cos $\alpha$ value to produce $\Omega_x$.

19. The apparatus of claim 17 wherein said first means includes (h) means responsive to $\Omega_x$, AA and $\Omega_v$ to derive a value $\Omega_B$, and (j) means responsive to $\Omega_y$ and $\Omega_B$ to derive said value $\psi$ for borehole azimuth.

20. The apparatus of claim 19 wherein said (h) means includes:

($h_1$) an arc sin generator responsive to AA to generate an output, ($h_2$) sin and cos generator means responsive to said output of the arc sin generator to generate an output sin $\phi$ and an output cos $\phi$, ($h_3$) multiplier means responsive to sin $\phi$ and $\Omega_v$ to produce a product thereof, ($h_4$) subtractor means responsive to said product and $\Omega_x$ to obtain a difference value, ($h_5$) divider means to divide said difference value by said output cos $\phi$ to obtain said value $\Omega_B$.

21. The apparatus of either one of claims 19 and 20 wherein said (i) means includes an arc tangent generator responsive to $\Omega_y$ and $\Omega_B$ to produce an output proportional to arc tan $(-\Omega_y/\Omega_B)$ which is representative of azimuth $\psi$.

22. The apparatus of claim 20 wherein said elements ($h_1$)-($h_5$) are operatively interconnected.

23. In well bore survey apparatus wherein angular rate sensor means and accelerometer means are located in a borehole, the angular rate sensor means having amplitude output GA and phase output GP, and the accelerometer means having amplitude output AA and phase output AP, there being means providing a value $\Omega_v$ proportional to earth's angular velocity vector, the combination comprising (a) means operatively connected to said sensors to be responsive to GA, GP and AP to derive a first component $\Omega_x$ of the angular rate sensor output, (b) means operatively connected to said sensors to be responsive to GA, GP and AP to derive a second component $\Omega_y$ of the angular rate sensor output, (c) means operatively connected to said (a) means to be responsive to $\Omega_x$, AA and $\Omega_v$ to derive a value $\Omega_B$, and (d) means operatively connected to said (b) and (c) means to derive $\psi$ from $\Omega_y$ and $\Omega_B$ wherein $\psi$ is an azimuth value indicative of the azimuth angle of the borehole relative to true North at the location of said sensor means.

24. The combination of claim 23 including (e) means responsive to AA to derive a value $\phi$ for borehole tilt at the location of said sensor means in the borehole.

25. The apparatus of either one of claims 15 and 23 including means suspending said rate sensor means and accelerometer sensor means in the borehole at an elevation at which said derivation of is carried out.

26. In borehole survey apparatus wherein magnetic sensor means and acceleration sensor means are suspended and effectively rotated in a borehole, the magnetic sensor means having amplitude output GA and rotation related phase output GP, and the acceleration sensor means having amplitude output AA and rotation related phase output AP, there also being means supplying a signal value $\Omega_v$ proportional to earth's angular rate of rotation, the improvement which comprises (a) first means for combining AA, AP, GA, GP and $\Omega_v$ to derive a value $\psi$ for borehole azimuth at the level of said sensor means in the borehole.

27. The apparatus of claim 26 including (b) second means operatively connected with said first means for employing AA to derive a value $\phi$ for borehole tilt from vertical at the level of said sensor means in the borehole.

28. The apparatus of claim 26 wherein said first means includes (c) means responsive to GA, GP and AP to derive (i) a first component $\Omega_x$ of the magnetic sensor output, and (ii) a second component $\Omega_y$ of the magnetic sensor output.

29. The apparatus of claim 28 wherein said (c) means to derive $\Omega_x$ and $\Omega_y$ includes (d) means responsive to GP and AP to produce a phase angle value $\alpha$ representative of the difference in phase of said GP and AP outputs, (e) means responsive to $\alpha$ to produce sin $\alpha$ and cos $\alpha$ values, (f) means to multiply GA and said sin $\alpha$ value to produce $\Omega_y$, and (g) means to multiply GA and said cos $\alpha$ value to produce $\Omega_x$.

30. The apparatus of claim 28 wherein said first means includes (h) means responsive to $\Omega_x$, AA and $\Omega_x$ to derive a value $\Omega_B$ and (j) means responsive to $\Omega_y$ and $\Omega_B$ to derive said value $\psi$ for borehole azimuth.

31. The apparatus of claim 30 wherein said (h) means includes:

($h_1$) an arc sin generator responsive to AA to generate an output, ($h_2$) sin and cos generator means responsive to said output of the arc sin generator to generate an output sin $\phi$ and an output cos $\phi$, ($h_3$) multiplier means responsive to sin $\phi$ and $\Omega_v$ to produce a produce thereof, ($h_4$) subtractor means responsive to said product and $\Omega_x$ to obtain a difference value, ($h_5$) divider means to divide said difference value by said output cos $\phi$ to obtain said value $\Omega_B$.

32. The method of claim 1 wherein said derivation of azimuth includes deriving a ratio of said component in the horizontal plane normal to the plane containing a borehole axis, and said component in the horizontal plane of the earth's angular velocity vector.

* * * * *